US006649125B2

(12) United States Patent
Hayaishi et al.

(10) Patent No.: US 6,649,125 B2
(45) Date of Patent: Nov. 18, 2003

(54) FREE-CUTTING STEEL

(75) Inventors: Masakazu Hayaishi, Nagoya (JP); Yutaka Kurebayashi, Nagoya (JP)

(73) Assignee: Daido Steel Co., Ltd., Nagoya (JP)

( * ) Notice: Subject to any disclaimer, the term of this patent is extended or adjusted under 35 U.S.C. 154(b) by 0 days.

(21) Appl. No.: 10/158,065

(22) Filed: May 31, 2002

(65) Prior Publication Data

US 2003/0072673 A1 Apr. 17, 2003

(30) Foreign Application Priority Data

Jun. 1, 2001 (JP) ..... 2001-167120
Apr. 30, 2002 (JP) ..... 2002-128847

(51) Int. Cl.[7] ..... C22C 38/60

(52) U.S. Cl. ..... 420/87; 420/88; 420/84

(58) Field of Search ..... 420/87, 88, 84

(56) References Cited

U.S. PATENT DOCUMENTS 4,279,646 A * 7/1981 Kato et al. ..... 420/83
5,922,145 A * 7/1999 Watari et al. ..... 420/41

* cited by examiner

*Primary Examiner*—Deborah Yee
(74) *Attorney, Agent, or Firm*—Varndell & Varndell, PLLC

(57) ABSTRACT

Disclosed is a free-cutting steel which exhibits good machinability in turning and small roughness of the turned surfaces, and in which substantially no macro-streak-flaw occurs. The free-cutting steel contains, by weight %, C: 0.03–0.20%, Mn: 0.5–3.0%, P: 0.02–0.40%, S: more than 0.2% up to 1.0%, one or both of Ti and Zr (in case of both, the total amount): 0.01–3.0%, O: 0.0005–0.0050% and Pb: less than 0.01%, the balance being Fe and inevitable impurities. The steel is characterized in that it contains, as the inclusion therein, Ti-based and/or Zr-based carbosulfide compound or compounds. The steel may further contain at least one from the group of Bi: up to 0.4%, Se: up to 0.5% and Te: up to 0.1%.

3 Claims, 2 Drawing Sheets

Example 7

Control 5

FREE-CUTTING STEEL

BACKGROUND OF THE INVENTION

The present invention concerns a free-cutting steel. More specifically, the invention concerns a free-cutting steel, in which Pb-content is less than the detectable limit, and therefore, which can be said Pb-free, but still machinability, particularly, machinability in turning, is excellent and the surface roughness after turning is in small.

To date, screws and nipples to which high strength is not required are manufactured by machining a free-cutting steel chosen as the material. In general, free-cutting steels are low carbon steels with addition of a machinability-improving element such as S, Pb, Te and Ca. Of these machinability-improving elements Pb is notorious by its effect of improving machinability in turning without damaging strength of the steel.

However, in view of the fact that Pb is a substance giving unfavorable influence to the environment, it is demanded to make the free-cutting steel Pb-free. Thus, efforts for developing free-cutting steel containing substantially no Pb but exhibiting machinability equal to or even better than that of the conventional Pb-containing free-cutting steel has been made. An example of such a free-cutting steel is a low carbon sulfur-free-cutting steel containing no Pb but S in an amount of, by weight %, more than 0.4% up to 1.0%, which is disclosed in Japanese Patent Disclosure No. 2000-319753.

The above described low carbon sulfur-free-cutting steel is a free-cutting steel of improved machinability in turning by containing soft MnS having a melting point around 1600° C. in dispersed form in the matrix thereof, and the MnS inclusion is utilized as the lubricant to decrease friction between the edge of tool and the matrix. In the case where the machinability in turning is the only concern among various machinabilities, the problem can be solved by having much amount of MnS formed in the steel.

The MnS inclusion particles, however, are easily elongated during rolling or forging, and therefore, when the steel containing much amount of MnS is machined by turning, the elongated MnS comes out of the matrix of steel to adhere to the edge of tool and a built-up edge is formed, which tends to grow. If the built-up edge grows, it may adhere to the turned surface, and this process may be repeated. Thus, there is a problem that the turned surface may be roughened and deteriorated, and the machined product will be of poor surface condition.

In order to avoid deterioration of the turned surface it is necessary to slow down the turning speed at the finishing machining. This causes lowering the producing efficiency and results in increased manufacturing cost.

Thus, there has been demand for such a free-cutting steel that has good machinability in turning and gives small surface roughness after turning. The inventors, with the intention to meet this demand, conducted research and development, and invented a novel free-cutting steel with addition of a suitable amount of Ti to form carbosulfide-type inclusions by combining Ti with C and S. The invention was already disclosed (Japanese Patent Application 2001-167120). The steel consists essentially of, by weight %, C: 0.03–0.20%, Si: up to 0.2%, Mn: 0.5–3.0%, P: 0.02–0.40%, S: more than 0.2% up to 1.0%, Ti: 0.01–3.0%, Al: up to 0.005%, O: 0.0005–0.040%, Pb: less than 0.01% and the balance of Fe and inevitable impurities, and is characterized by Ti-based carbosulfide inclusions, typically, $Ti_4C_2S_2$ therein.

Our further research revealed the facts that the contents of Si and Al are not so important in the free-cutting steel and that, if the O-content is at a higher level in the above range, macro-streak-flaw tends to occur. Occurrence of the macro-streak-flaw is an important problem from the viewpoint of steel quality and must be prevented. At such a decreased O-level as 0.005% or less the macro-streak-flaw is no longer a problem, and it was ascertained by our research that the desired machinability is attainable at this low O-content. Our research further ascertained that Zr has the same effect as Ti, and therefore, a part or whole of Ti can be replaced by Zr.

SUMMARY OF THE INVENTION

The object of the invention is to provide, by utilizing the novel knowledge concerning the above-described free-cutting steel containing Ti-based carbosulfide inclusion, an improved free-cutting steel which has good machinability, particularly in turning, and small surface roughness after being turned, and no substantial problem on the macro-streak-flaw thereof.

The free-cutting steel according to the present invention, which achieves the above-mentioned object, contains, by weight %, C: 0.03–0.20%, Mn: 0.5–3.0%, P: 0.02–0.40%, S: more than 0.2% up to 1.0%, one or both of Ti and Zr (in case of both, the total amount): 0.01–3.0%, O: 0.0005–0.0050% and Pb: less than 0.01%, the balance being Fe and inevitable impurities, and the steel containing, Ti-based and/or Zr-based carbosulfide compound or compounds as the inclusion therein.

DETAILED EXPLANATION OF THE PREFERRED EMBODIMENTS

Figure 1:
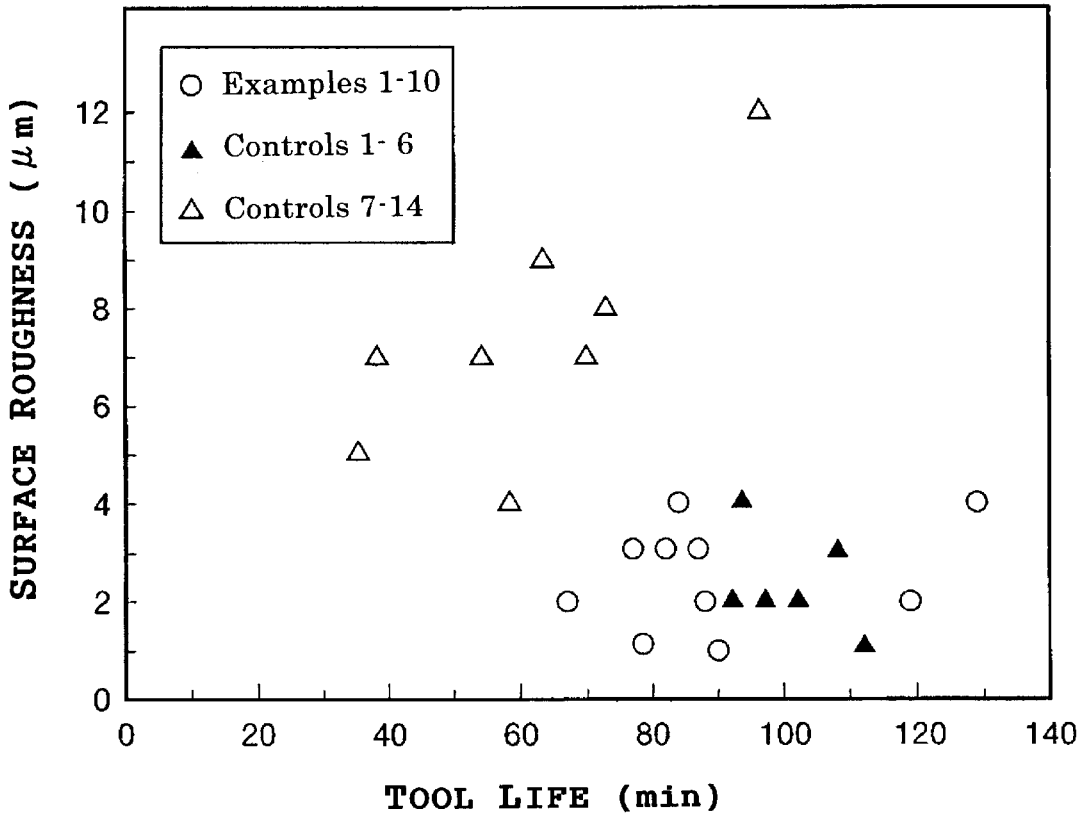
FIG. 1 is the data of the examples of the invention, illustrating the relation between the tool lives and the surface roughness in the working and control examples.

The above noted Ti-based and/or Zr-based carbosulfide inclusion is preferably $(Ti,Zr)_4C_2S_2$. In the following description the term "Ti-carbosulfide inclusion" represents the Ti-based and/or Zr-based carbosulfide inclusion. The present free-cutting steel is the alloy so designed that MnS and the Ti-carbosulfide inclusion may coexist in the matrix of the steel.

The free-cutting steel of the invention may further contain, in addition to the alloy components mentioned above, by weight %, at least one from the group of Bi: up to 0.4%, Se: up to 0.5% and Te: up to 0.1%.

Low carbon sulfur-free-cutting steels containing much MnS in the matrix have good machinability in turning, while the surface roughness after turning is not good because of the above explained formation of built-up edges. To suppress the deterioration of the surface condition it is effective to decrease the S-content so that the amount of MnS formed may not be so much. In that case, however, it is inevitable that the machinability in turning goes down.

In the present invention the good machinability in turning and improved surface condition, which have been contradictory in the conventional low carbon sulfur-free-cutting steel, can be consistent by, while allowing formation of a certain amount of MnS, having the Ti-carbosulfide inclusions precipitated in the matrix. The Ti-carbosulfide has the melting point nearly the same as that of MnS and contributes to improvement in the machinability by the same mechanism as that by MnS. The Ti-carbosulfide inclusions precipitate in particle forms which are dispersed in the matrix, and are not elongated like MnS inclusions.

Thus, machinability of the free-cutting steel in which MnS and Ti-carbosulfide inclusions coexist is, even though the amount of MnS formed is relatively low, compensated by the Ti-carbosulfide inclusion and will never be insufficient. The steel containing a smaller amount of MnS have little fear of growth of built up edges, and further, because the Ti-carbosulfide inclusions do not cause building up of the edges, growth of the built up edges will be, when compared with the conventional steel containing much MnS, well suppressed. Thus, the problem of compatiblility of machinability in turning and improvement in the surface condition after turning can be solved.

The macro-streak-flaw is caused mainly by hard oxide inclusions, more specifically, $SiO_2$ and $Al_2O_3$. Both Si and Al are added to the steel during steel making or contained in the materials, and therefore, it is difficult to extremely lower the contents of these elements in the steel. The present invention, as described above, succeeded in preventing occurrence of the macro-streak-flaw by lowering the oxygen content so as to decrease the amount of oxides formed.

The present free-cutting steel was developed on the basis of the above technical thought and the alloy design was made with a view to coexist two kinds of inclusions, the MnS inclusion and Ti-carbosulfide inclusion. The following explains reasons for determining the alloy composition of the present free-cutting steel.

C: 0.03–0.20%

Carbon is an element which ensures strength of the steel and improves the surface condition after turning by combining with Ti and S to form the Ti-carbosulfide inclusion. The effect is not obtained at a C-content less than 0.03%. On the other hand, excess content of C will give too high a hardness to the steel, which results in lowered machinability in turning. Therefore, the upper limit of the C-content is set to be 0.20%.

Mn: 0.5–3.0%

Manganese is an essential element combining with S to form MnS which ensures the machinability in turning. At a small content less than 0.5% this effect is not obtainable, while a large content more than 3.0% will outrageously heighten hardness of the steel to decrease the machinability in turning. Thus, addition of Mn is made in the range of 0.5–3.0%.

P: 0.02–0.40%

Phosphor in the present steel is not just an impurity, but a useful element which improves machinability in turning, especially properties of the finished surface. P-content less than 0.02% will give insufficient machinability-improving effect. However, extremely high P-content makes the steel brittle and resilience will be significantly decreased, and the upper limit of P-content is set to be 0.4%.

S: More than 0.2% up to 1.0%

Sulfur has, like C and Mn, and further, Ti mentioned later, effect of improving the machinability in turning of the steel. As described above, sulfur not only forms MnS but also combines with Ti and C to form the Ti-carbosulfide inclusion, and improves the machinability in turning without roughening the turned surface. At an S-content less than 0.2%, the amounts of the formed MnS inclusion and Ti-carbosulfide inclusion are too small, and the effect of improving the machinability and suppressing the surface roughening cannot be expected. On the other hand, S-content more than 1.0% significantly decreases hot workability of the steel.

One or Both of Ti and Zr (in Case of Both, the Total Amount): 0.01–3.0%

Titanium and zirconium (hereinafter represented by "Ti"), like MnS, through the mechanism that whole or part of these elements combines with C and S to form the Ti-carbosulfide, heighten the machinability in turning and suppress the surface roughening at turning. These merits are not given by MnS only. Ti-content less than 0.01% is not effective. At a higher addition amount, however, the effect will saturate, and therefore, addition of Ti in an amount up to 3.0% is advisable.

O: 0.0005–0.0050%

Oxygen is an element remarkably influencing the aspect of the sulfides formed in the steel, especially MnS. In case where the O-content in the steel is low, MnS particles formed in the molten steel become small and are elongated during hot processing such as hot rolling or hot forging, and lowers the machinability in turning of the steel. The lower limit of the O-content, 0.0005%, is the lowest content realizable in the ordinary steel making. The above-discussed influence of oxygen on the aspect of MnS inclusions is, therefore, the matter at the O-content exceeding this lower limit. On the other hand, in case where a large amount of oxygen is contained in the steel, there is a problem, in addition to disadvantage of increased dissolution-loss of refractory at the steel making, that due to hard inclusion particles of the oxides, which come from the refractory into the molten steel or formed by combination of oxygen with Si or Al in the molten steel and subsequent precipitation, machinability in turning of the steel is damaged.

As mentioned above, contents of Si and Al in the present free-cutting steel have no importance. These elements are, however, more or less essential as the deoxidizing agents, particularly, for the present steel in which O-content is relatively small. The lower limits from this point of view are 0.03% for Si and 0.003% for Al. The oxides resulting from deoxidation with Si and Al are hard inclusions decreasing the machinability in turning, and therefore, the contents of these elements should not be so high. Recommended upper limits are 0.5% for Si and 0.3% for Al.

As also mentioned above, the free-cutting steel of this invention contains no lead. The lowest detectable limit of Pb by conventional analysis method is 0.01%, and therefore, the content of Pb in this steel is, even if any, less than 0.01%.

The reasons for limiting the contents of optionally added alloy components, Bi, Se and Te, as noted above are as follows.

Bi: up to 0.4%

Bismuth is a component improving the machinability in turning. An amount of Bi more than 0.4%, even if added, exceeds the soluble limit in the steel. Excess, undissolved Bi will, due to the high density thereof, sediment and coagulate to form defects in the steel.

Se: up to 0.5%

Selenium also improves the machinability in turning. Addition in an amount more than 0.5% lowers hot workability of the steel and results in occurrence of cracks during rolling or forging.

Te: up to 0.1%

Like Bi and Se, tellurium improves the machinability in turning. Addition of Te in an amount exceeding 0.1% causes, like Se, decrease of hot workability, which results in cracking.

As can be understood from the above explanation, the free-cutting steel of the invention, because of carefully selected alloy components and composition ranges, including the suitable oxygen content, and dispersion of Ti-carbosulfide inclusions therein, exhibits good machinability in turning, despite of substantially no contention of Pb, without surface roughening after turning and with no problem of macro-streak-flaws. Use of the present free-cutting steel eliminates necessity of slow down in feed rate at finishing turning and efficient machining can be carried out. The invention thus contributes to cutting manufacturing costs of various machine parts.

EXAMPLES

Working Examples 1–10 and Control Examples 1–14

Steels of the alloy composition shown in TABLE 1 (Examples) and TABLE 2 (Controls) were prepared with an HF-induction furnace, and the steels were cast into ingots weighing 150 kg. The ingots were forged by hot forging with a forging ratio of 8 into round rods of diameter 55 mm. From the round rods, after normalizing treatment of 950° C.-air cooling, test pieces for machining tests were taken.

Each 10 (ten) test pieces of these samples were inspected as to whether they have macro-streak-flaws and the numbers of the flaws were recorded. Evaluation is as follows:

A: no flaw observed in all the pieces
B: 1–9 pieces of 10 have a flaw or flaws
C: all (10) pieces have a flaw or flaws Machining tests were carried out using these test pieces under the following conditions:

| | |
|---|---|
| Cutting Tool: | Cemented carbide "K10" |
| Cutting Speed: | 150 m/min |
| Feed Rate: | 0.1 mm/rev |
| Depth of Cut: | 1 mm |
| Cutting Oil: | Oil |
| Tool Life: | Period of turning until the averaged frank abrasion at side clearance reaches 100 $\mu$m |

Outer surfaces of the same samples for cutting tests were machined by turning for a length of 100 m. After the turning the test pieces were placed on a V-block and the surface roughness was determined by moving the stylus of a roughness meter in the direction of the axis of the tested pieces. The maximum values were recorded as the outer surface roughness.

Figure 2:
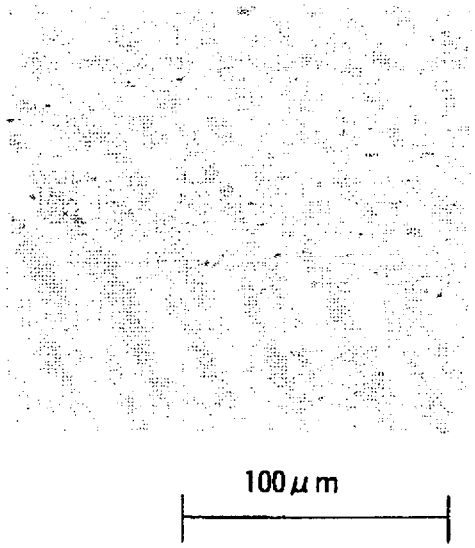
FIG. 2 is a microscopic photo showing the sample of Run. No. 7 of the working example according to the present invention.
Figure 3:
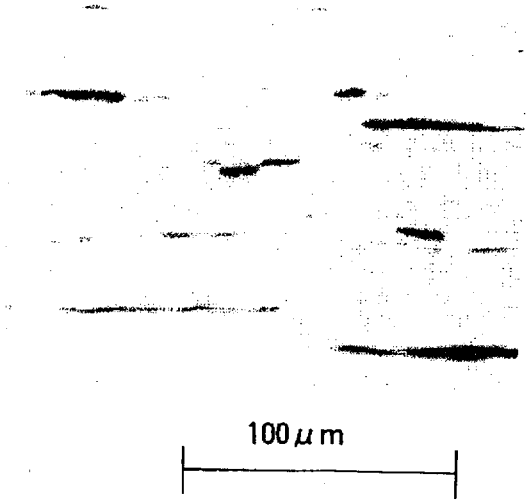
FIG. 3 is a microscopic photo, like FIG. 2, showing the sample of Run No. 5 of the control example of the present invention.

The test results are shown together with the steel compositions in TABLE 1 and TABLE 2. The relation between the tool lives and the surface roughness is shown in the graph of FIG. 1. The test pieces of Run No. 7 of the Working Example and Run No. 7 of the Control Example were cut and polished, and after etching treatment, observed with a microscope. The microscopic images are shown in the photos of FIG. 2 and FIG. 3.

As seen from the data of TABLES 1, TABLE 2 and FIG. 1, the free-cutting steel according to the invention (Run No. 1–10 of Examples) exhibited good relation between the tool lives and the surface roughness, and further, there is no problem in regard to the macro-streak-flaw. Contrarily to this, of the free-cutting steels of the Control Examples, the tool lives and the surface roughness (Run No. 1–6) have many macro-streak-flaws, and those showing better results of the macro-streak-flaws (Run No. 7–14) have shorter tool lives, or serious surface roughness, or both of them.

In the structure of Run No. 7 of the Working Examples there were observed both somewhat elongated, string-shaped MnS inclusions and particulate Ti-carbosulfide inclusions. Analysis with an wavelength-dispersed type EPMA of the inclusions detected Ti, C and S. In contrast, in the structure of Run No. 5 of the Control Examples there was observed only MnS inclusions which are, as seen in FIG. 3, elongated and larger than the MnS inclusions observed in the above mentioned Run No. 7 of the Working Examples.

TABLE 1

| | Working Examples | | | | | | | | | | |
|---|---|---|---|---|---|---|---|---|---|---|---|
| | Alloy Compositions | | | | | | | | | Tool | Rough- |
| No. | C | Si | Mn | P | S | Ti/Zr | Al | O | MSF*1 | Life | ness*2 |
| 1 | 0.08 | 0.01 | 0.49 | 0.048 | 0.216 | Ti0.71 | 0.019 | 0.0032 | A | 87 min | 3 $\mu$m |
| 2 | 0.18 | 0.03 | 1.61 | 0.022 | 0.802 | Ti1.39 | 0.032 | 0.0022 | A | 129 | 4 |
| 3 | 0.08 | 0.02 | 0.80 | 0.053 | 0.399 | Ti0.24 | 0.016 | 0.0041 | A | 90 | 1 |
| 4 | 0.07 | 0.02 | 0.74 | 0.154 | 0.329 | Ti0.52 | 0.018 | 0.0035 | A | 79 | 1 |
| 5 | 0.12 | 0.03 | 1.11 | 0.108 | 0.256 | Ti0.19 | 0.023 | 0.0026 | A | 88 | 2 |
| 6 | 0.29 | 0.06 | 0.87 | 0.031 | 0.956 | Ti2.76 | 0.043 | 0.0017 | A | 77 | 3 |
| 7 | 0.08 | 0.02 | 0.56 | 0.029 | 0.319 | Ti0.56 | 0.021 | 0.0037 | A | 118 | 2 |
| 8 | 0.09 | 0.41 | 0.61 | 0.012 | 0.339 | Ti0.87 | 0.121 | 0.0018 | A | 67 | 2 |
| 9 | 0.12 | 0.12 | 0.92 | 0.045 | 0.408 | Zr0.54 | 0.019 | 0.0037 | A | 81 | 3 |
| 10 | 0.10 | 0.04 | 0.77 | 0.037 | 0.392 | Ti0.54 Zr0.21 | 0.034 | 0.0028 | A | 84 | 4 |

*1Evaluation of Macro-Streak-Flaw A: no flaw observed in 10 samples B: 1–9 flaws observed in 10 samples C: flaws observed in all the samples
*2maximum roughness at outer turned surface

TABLE 2

| | Control Examples | | | | | | | | | | |
|---|---|---|---|---|---|---|---|---|---|---|---|
| | Alloy Compositions | | | | | | | | | Tool Life | Roughness |
| No. | C | Si | Mn | P | S | Ti/Zr | Al | O | MSF | (min) | (μm) |
| 1 | 0.14 | <0.01 | 1.23 | 0.046 | 0.328 | Ti0.87 | <0.002 | 0.0152 | C | 92 | 3 |
| 2 | 0.08 | <0.01 | 0.47 | 0.047 | 0.599 | Ti1.26 | <0.002 | 0.0100 | C | 112 | 1 |
| 3 | 0.06 | <0.01 | 0.95 | 0.039 | 0.287 | Ti0.77 | <0.002 | 0.0064 | B | 96 | 2 |
| 4 | 0.19 | 0.01 | 1.09 | 0.029 | 0.498 | Ti0.94 | 0.002 | 0.0133 | C | 108 | 3 |
| 5 | 0.11 | <0.01 | 0.88 | 0.049 | 0.303 | Zr0.59 | 0.003 | 0.0084 | C | 93 | 4 |
| 6 | 0.12 | 0.02 | 0.63 | 0.061 | 0.349 | Ti0.48 Zr0.22 | <0.002 | 0.0071 | B | 102 | 2 |
| 7 | 0.09 | <0.01 | 1.10 | 0.055 | 0.497 | Ti<0.002 | 0.003 | 0.0168 | A | 62 | 9 |
| 8 | 0.04 | <0.01 | 1.05 | 0.041 | 0.408 | Ti<0.002 | <0.002 | 0.0332 | A | 54 | 7 |
| 9 | 0.18 | 0.03 | 0.98 | 0.049 | 0.488 | Ti<0.002 | <0.002 | 0.0269 | A | 35 | 5 |
| 10 | 0.10 | 0.01 | 0.65 | 0.077 | 0.412 | Ti<0.002 | <0.002 | 0.0158 | A | 37 | 7 |
| 11 | 0.08 | <0.01 | 1.90 | 0.026 | 0.632 | Ti<0.002 | 0.002 | 0.0189 | A | 72 | 8 |
| 12 | 0.07 | 0.01 | 0.88 | 0.103 | 0.589 | Ti<0.002 | <0.002 | 0.0362 | A | 96 | 12 |
| 13 | 0.06 | 0.01 | 1.29 | 0.333 | 0.498 | Ti<0.002 | <0.002 | 0.0296 | A | 70 | 7 |
| 14 | 0.08 | <0.01 | 2.55 | 0.038 | 0.956 | Ti<0.002 | 0.002 | 0.0129 | A | 58 | 4 |

We claim:

1. A free-cutting steel which consists essentially of, by weight %, C: 0.03–0.20%, Mn: 0.5–3.0%, P: 0.02–0.40%, S: more than 0.2% up to 1.0%, one or both of Ti and Zr (in case of both, the total amount): 0.01–3.0%, O: 0.0005–0.0050% and Pb: less than 0.01%, the balance of Fe and inevitable impurities, the steel containing, Ti-based and/or Zr-based carbosulfide compound or compounds as inclusions therein.

2. A free-cutting steel according to claim 1, wherein the Ti-based and/or Zr-based carbosulfide inclusion is $(Ti,Zr)_4C_2S_2$.

3. A free-cutting steel according to claim 1, wherein the steel contains, in addition to the alloy components set forth in claim 1, by weight %, at least one from the group of Bi: up to 0.4%, Se: up to 0.5% and Te: up to 0.1%.

* * * * *